US010374348B2

(12) United States Patent
Tanikawa

(10) Patent No.: US 10,374,348 B2
(45) Date of Patent: Aug. 6, 2019

(54) TERMINAL FITTING

(71) Applicant: Sumitomo Wiring Systems, Ltd., Yokkaichi, Mie (JP)

(72) Inventor: Naotaka Tanikawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/032,141

(22) Filed: Jul. 11, 2018

(65) Prior Publication Data

US 2019/0036258 A1 Jan. 31, 2019

(30) Foreign Application Priority Data

Jul. 27, 2017 (JP) ..... 2017-145161

(51) Int. Cl.

*H01R 13/11* (2006.01)
*H01R 13/05* (2006.01)
*H01R 13/42* (2006.01)
*H01R 13/187* (2006.01)

(52) U.S. Cl.

CPC ..... *H01R 13/113* (2013.01); *H01R 13/055* (2013.01); *H01R 13/42* (2013.01); *H01R 13/187* (2013.01)

(58) Field of Classification Search

CPC ..... H01R 13/113; H01R 13/115
USPC ..... 439/851
See application file for complete search history.

(56) References Cited

U.S. PATENT DOCUMENTS 5,601,458 A * 2/1997 Ohsumi ..... H01R 13/187 439/851
5,989,078 A * 11/1999 Chaillot ..... H01R 43/16 439/851
6,450,843 B1 * 9/2002 Heimuller ..... H01R 13/11 439/843
6,544,080 B1 * 4/2003 Yamamoto ..... H01R 13/113 439/849
7,485,016 B2 * 2/2009 Ishigami ..... H01R 4/184 439/748
8,821,197 B2 * 9/2014 Muro ..... H01R 13/113 439/830
8,827,756 B2 * 9/2014 Mueller ..... H01R 13/112 439/852

(Continued)

FOREIGN PATENT DOCUMENTS

JP 5-53146 7/1993

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A terminal fitting to be connected to a mating terminal fitting with a tab (T) includes a rectangular tube (11) composed of a bottom wall (12), two side walls (13) rising from the bottom wall (12) and a ceiling wall (15) facing the bottom wall (12). A resilient contact (21) extends along the bottom wall (12) inside the rectangular tube (11). A protection wall (31, 131) has bending edge (L1) continuous with one of the side walls (13) is before a front end (12A) of the bottom wall (12) and extends from the bending edge (L1) toward the other side wall (13). A clearance for receiving the tab (T) is between the protection wall (31, 131) and the ceiling wall (15). The bending edge (L1) approaches the ceiling wall (15) from a front end (12A) of the bottom wall (12) toward a front end (13A) of the side wall (13).

4 Claims, 8 Drawing Sheets

(56) References Cited

U.S. PATENT DOCUMENTS

| | | | | |
|---|---|---|---|---|
| 8,911,253 | B2 * | 12/2014 | Myer | H01R 13/113 439/561 |
| 9,099,796 | B2 * | 8/2015 | Myer | H01R 13/113 |
| 9,105,995 | B2 * | 8/2015 | Tsuji | H01R 13/113 |
| 9,490,563 | B2 * | 11/2016 | Shinmi | H01R 13/115 |
| 9,515,396 | B2 * | 12/2016 | Chikusa | H01R 13/113 |
| 2012/0315806 | A1 * | 12/2012 | Myer | H01R 13/113 439/861 |
| 2014/0141662 | A1 * | 5/2014 | Kutsuna | H01R 13/114 439/888 |
| 2015/0099408 | A1 * | 4/2015 | Myer | H01R 13/113 439/884 |
| 2016/0079686 | A1 * | 3/2016 | Shinmi | H01R 13/115 439/842 |

* cited by examiner

TERMINAL FITTING

BACKGROUND

Field of the Invention

This specification relates to a terminal fitting.

Description of the Related Art

Japanese Utility Model Publication No. H05-53146 disclose a socket contact that includes a pin contact receiving portion in the form of a rectangular tube and a spring contact portion arranged inside the pin contact receiving portion. A tab is provided with an upright wall constituting the pin contact receiving portion. The tab is bent inward at a right angle to close an opening of the pin contact receiving portion and serves as a pin contact receiving portion cover.

However, a slit is provided in a base end of the tab to accommodate a plate thickness of the tab and to fit a front surface of the tab in the pin contact receiving portion. Thus, the tab is long and narrow and is deformed easily in response to an external force. Further, stress easily concentrates on the slit, and a crack easily is formed with the slit as a base.

SUMMARY

A terminal fitting disclosed in this specification is to be connected to a mating terminal fitting with a tab and includes a rectangular tube portion composed of a bottom wall, first and second side walls rising from the bottom wall and a ceiling wall continuous from at least one of the side walls and disposed to face the bottom wall. A resilient contact piece is arranged along the bottom wall inside the rectangular tube. At least one protection wall has a bending edge continuous with one of the side walls and is disposed before a front end of the bottom wall. The protection wall extends from the one bending edge toward the other side wall. A clearance is provided between the protection wall and the ceiling wall for allowing the entrance of the tab. The one bending edge approaches the ceiling wall from a front end of the bottom wall toward a front end edge of the side wall.

According to this configuration, the one bending edge approaches the ceiling wall from the front end of the bottom wall toward the front end of the side wall (i.e. to be oblique to the bottom wall). The one bending edge is longer, for example, as compared to the case where the side wall is perpendicular to the bottom wall to form the protection wall. Thus, a shear area on the bending edge becomes larger and strength against an external force is enhanced. In this way, the protection wall portion can have a high rigidity.

Further, for example, in the case of bending the side wall in the direction perpendicular to the bottom wall portion, a slit matching a plate thickness has to be provided in the side wall to accommodate the plate thickness of the protection wall in the rectangular tube. However, stress concentrates on the slit and easily can cause damage such as a crack. In contrast, according to the above configuration, the protection wall portion is formed by folding a part of the side wall inward. Thus, the protection wall need not project from a leading end edge of the rectangular tube and, hence, a slit need not be provided. Thus, the terminal fitting can be made less susceptible to deformation and damage against an external force by eliminating the slit.

The at least one protection wall may comprise first and second protection walls provided respectively on the first and second side walls. According to this configuration, the protection walls project toward each other from the respective side walls. Thus, the protection walls can have a high rigidity as compared to a single protection wall provided to be continuous only with one side wall and extending long toward the other side wall.

The bending edge may extend straight from the front end of the bottom wall to the front end edge of the side wall. According to this configuration, the protection wall can be formed easily since the protection wall can be formed by being bent along the straight bending edge from the side wall.

According to this specification, it is possible to provide a terminal fitting less likely to deform against an external force.

DETAILED DESCRIPTION

A first embodiment is described with reference to FIGS. 1 to 7. Note that only either one is described for bilaterally symmetrical structures and corresponding structures are denoted by the same reference signs.

Figure 1:
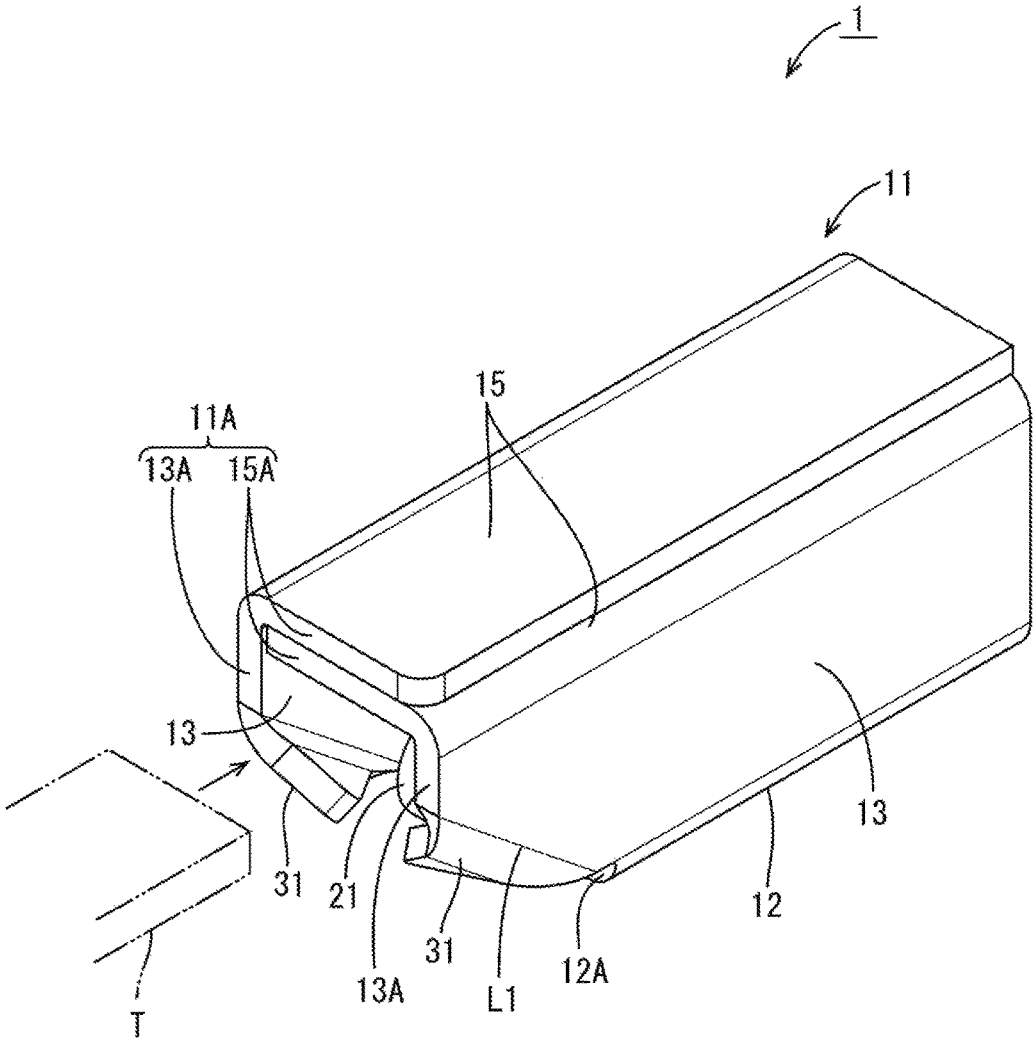
FIG. 1 is a perspective view showing a terminal fitting of a first embodiment.
Figure 2:
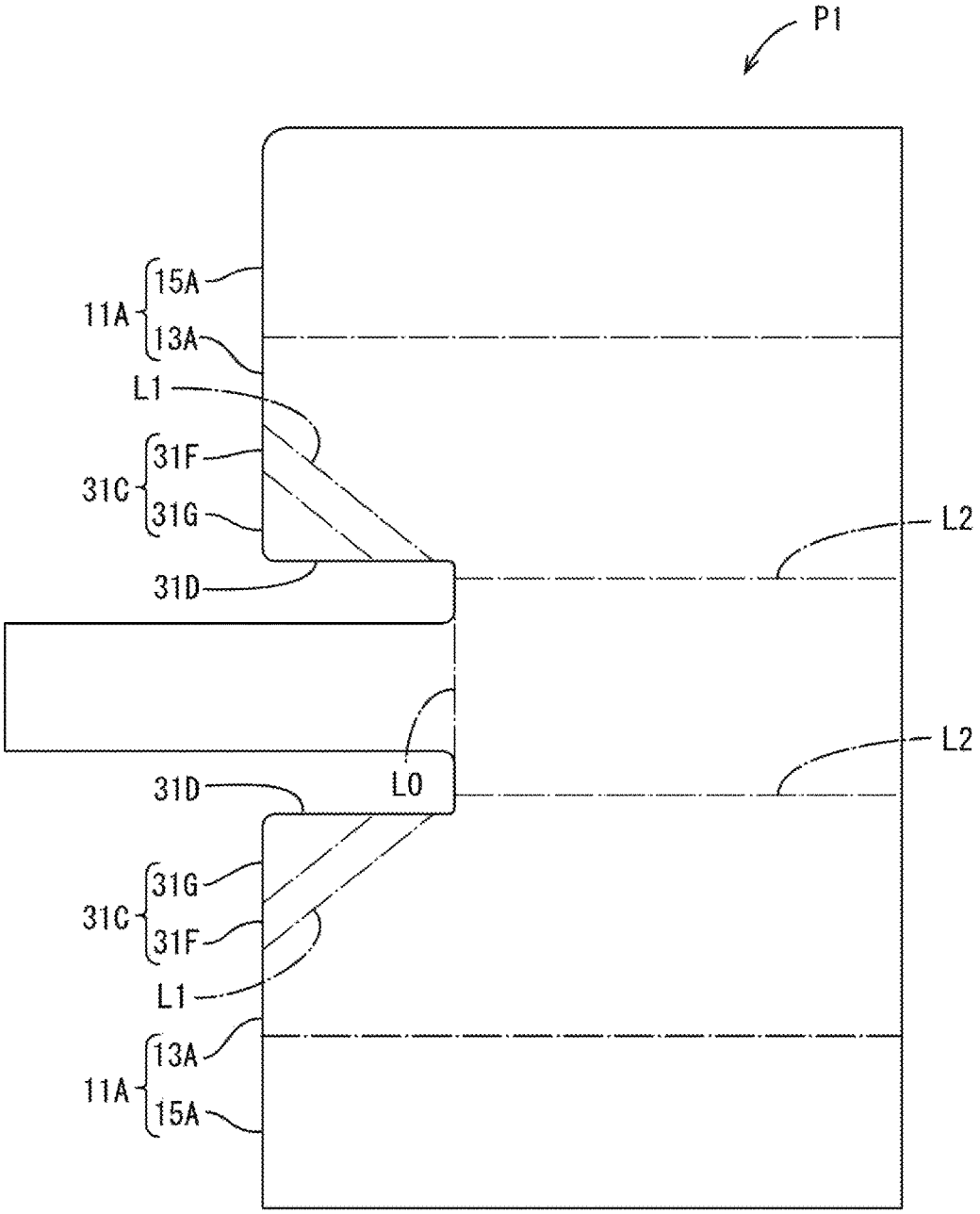
FIG. 2 is a view showing a development state of the terminal fitting.

A terminal fitting 1 of this embodiment is a female terminal fitting to be connected to a mating male terminal fitting and is formed by stamping and bending a single metal plate material P1 shown in FIG. 2. As shown in FIG. 1, this terminal fitting 1 integrally includes a rectangular tube 11 configured to receive a tab T of the mating terminal fitting inside, a resilient contact piece 21 disposed inside the rectangular tube 11 and configured to contact the tab T of the mating terminal fitting, and two protection walls 31 continuous from the rectangular tube 11 and configured to protect the resilient contact piece 21. Note that, in the following description, a side into which the T is to be inserted (a left-lower side in FIG. 1) is referred to as a front.

As shown in FIG. 1, the rectangular 11 is open on both ends, and includes a bottom wall 12, first and second side walls 13 and a ceiling wall 15. The bottom wall 12 is formed from a rectangular region defined by an imaginary line L0 and two imaginary lines L2 in FIG. 2. The side walls 13 are long and narrow plates respectively rising perpendicular from opposite first and second sides of the bottom wall 12 to face each other. The ceiling wall 15 faces the bottom wall 12 and is formed by two long narrow ceiling plates extending toward each other from upper ends of the side walls 13, 13 to vertically overlap. Front end edges 13A of the side walls 13 and a front edge 15A of the ceiling wall 15 are aligned in position in a front-rear direction and serve as a leading end edge 11A of the rectangular tube 11 as a whole.

Figure 4:
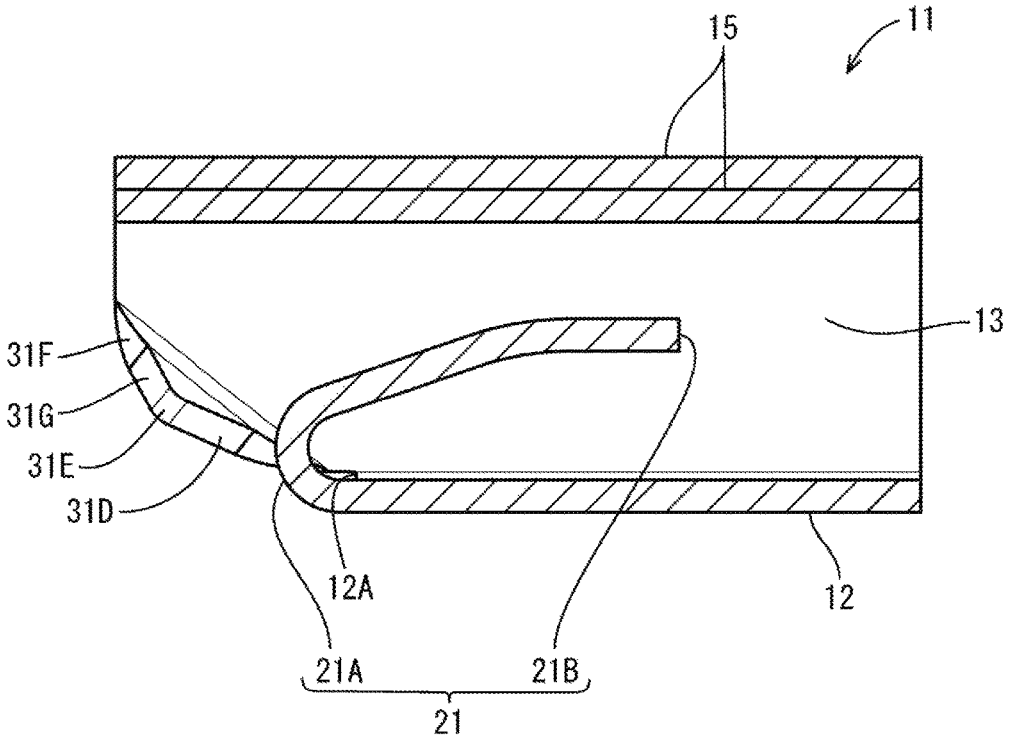
FIG. 4 is a section along A-A of FIG. 3.

As shown in FIGS. 2 and 4, the bottom wall 12 is shorter than the side walls 13, 13 and ceiling wall 15 in one end part (left end part in FIG. 4) of the rectangular tube 11, and a front end 12A thereof is located behind the leading end edge 11A of the rectangular tube 11. In other words, the other three walls 13, 13 and 15 extend farther forward than the bottom wall 12.

As shown in FIG. 4, the resilient contact piece 21 is a leaf spring arranged inside the rectangular tube 11 and extends along the bottom wall 12. One end of this resilient contact piece 21 serves as a base end 21A curved from the front end 12A of the bottom wall 12 to be folded into the rectangular tube 11, and the other end serves as a free end 21B. Most of the resilient contact piece 21 on a side near the base end 21A is separated gently from the bottom wall 12 with distance from the base end 21A, and the remaining part the free end 21B extends in parallel to the bottom wall 12.

Figure 3:
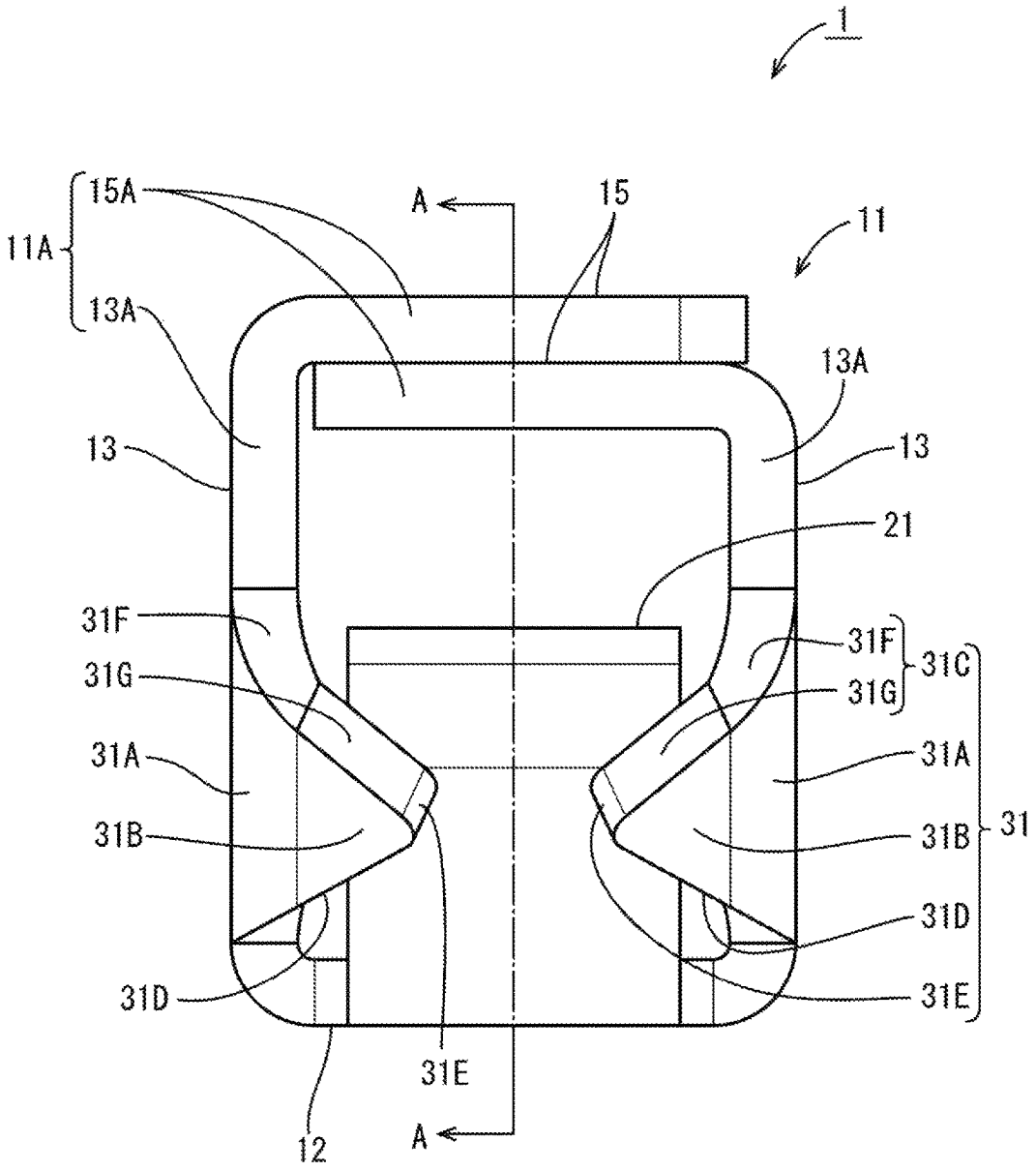
FIG. 3 is a front view of the terminal fitting.

The protection walls 31 are continuous with the respective side walls 13. Each protection wall 31 extends from the vicinity of a coupling of the front end 12A of the bottom wall 12 and the side wall 13 toward the front end edge 13A of the side wall 13 and from a bending edge L1 extending obliquely to the bottom wall 12 toward the other side wall 13. As shown in FIG. 3, each protection wall 31 is a plate extending from the bending edge L1 of the respective side wall 13 toward the opposite side wall 13. The protection walls 31 are disposed before the front end 12A of the bottom wall 12 and form a clearance for allowing the entrance of the tab T between the protection walls 31 and the ceiling wall 15.

Figure 5:
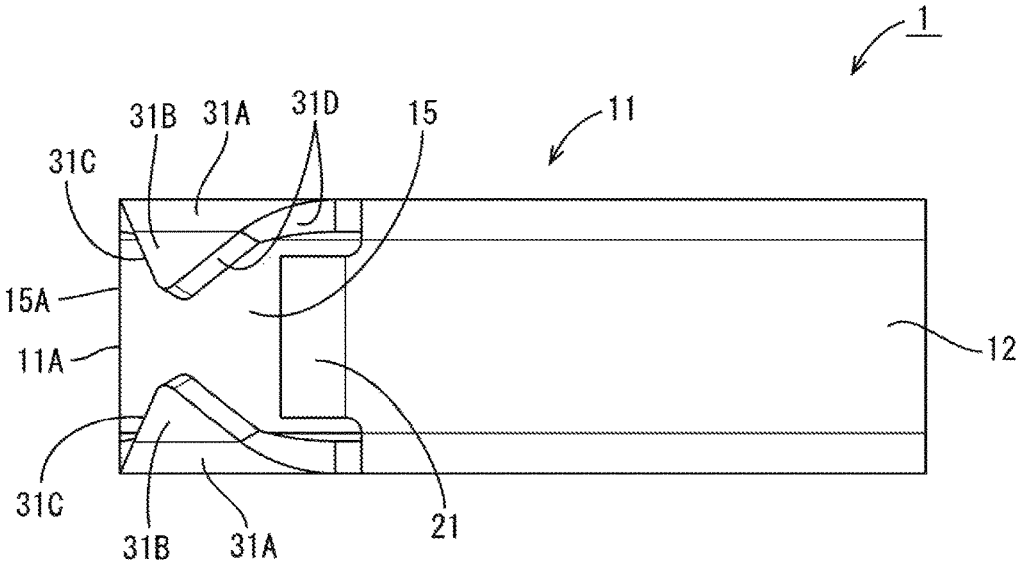
FIG. 5 is a bottom view of the terminal fitting.

Specifically, as shown in FIGS. 3 and 5, the shown first protection wall 31 includes a curved portion 31A gently curved from the shown right bending edge L1 toward the second side wall 13 and a flat plate 31B extending strength from the curved portion 31A.

In this embodiment, an upper edge 31F of the curved portion 31A constituting an upper edge 31C of the protection wall 31 and an upper edge 31G of the flat plate 31B are formed into a straight shape together with the front end edge 13A of the side wall 13 in a state of the metal plate material P1 as shown in FIG. 2. An angle between the upper edge 31C and a lower edge 31D of the protection wall 31 is a right angle.

Figure 6:
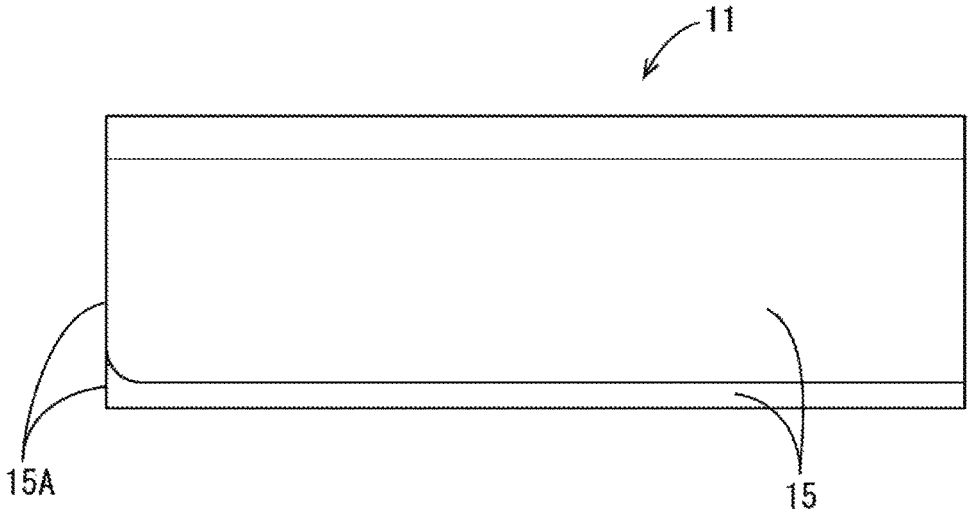
FIG. 6 is a top view of the terminal fitting.
Figure 7:
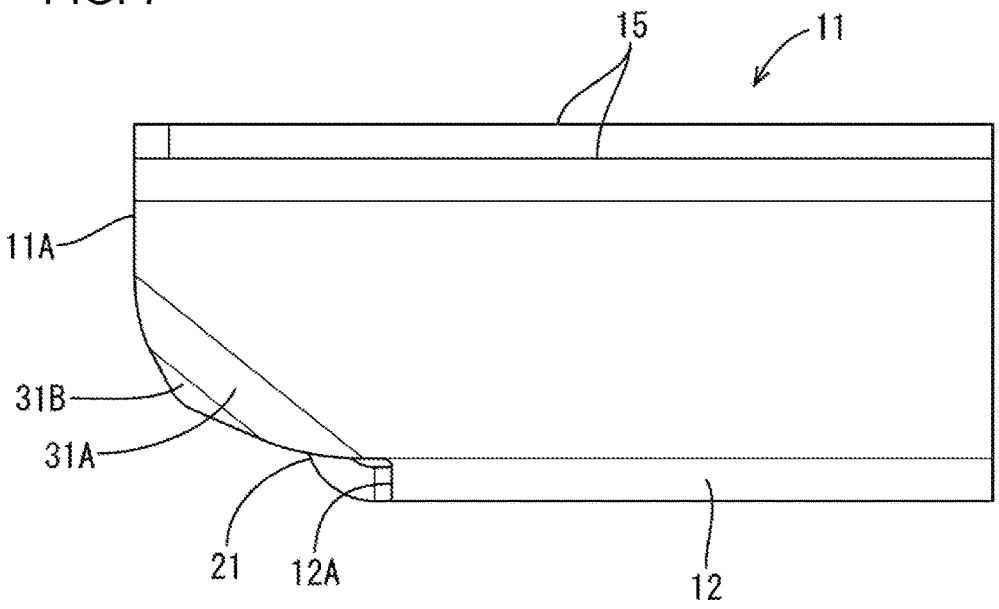
FIG. 7 is a side view of the terminal fitting.

The protection walls 31 cover a part of the resilient contact piece 21 from the front, as shown in FIG. 3. This causes the protection walls 31 to interfere with external matter entering toward the resilient contact piece 21 from a front surface side of the rectangular tube 11 to restrict the entrance, thereby preventing the resilient contact piece 21 from being damaged by the external matter. Note that, in this state, the entire protection walls 31 are located behind the leading end edge 11A of the rectangular tube 11, as shown in FIG. 5 and covered by the rectangular tube 11 (ceiling wall 15 and side walls 13) in a top view and a side view as shown in FIGS. 6 and 7.

When this terminal fitting 1 is connected to the mating terminal fitting, the tab T is inserted into the rectangular tube 11 through the clearance between the ceiling wall 15 and the protection walls 31, as shown in FIG. 1. During insertion into the rectangular tube 11, the tab T contacts the upper surface of the resilient contact piece 21 on the side of the free end part 21B shown in FIG. 4 to press the resilient contact piece 21 down. In this way, the terminal fitting 1 and the mating terminal fitting are connected electrically.

External matter may contact the protection wall 31. Thus, an external force acts as a shear force on the coupling part (plate thickness part on the bending edge L1) of the protection wall 31 and the side wall 13. If the external force acts beyond allowable stress of an area (shear area) of this part, the protection wall 31 is deformed or shear-fractured from this coupling part.

In contrast, according to the above configuration, the bending edge L1 approaches the ceiling wall 15 from the side of the bottom wall 12 toward the front edge 13A on the side wall 13 (i.e. inclined with respect to the bottom wall 12), and the bending edge L1 is, for example, longer than the one when the side wall 13 is provided in a direction perpendicular to the bottom wall 12. Thus, a shear area on the bending edge becomes larger and strength against an external force is enhanced. In this way, the protection wall 31 can be formed to have a high rigidity.

In the case of bending the side wall 13 perpendicular to the bottom wall 12, a slit matching a plate thickness has to be provided in the side wall 13 to accommodate the plate thickness of the protection wall 31 in the rectangular tube 11. However, stress concentrates on the slit and can cause damage, such as a crack. In contrast, the above-described protection wall 31 is formed by folding a part of the side wall 13 inward so that the protection wall 31 need not project from the rectangular tube 11 and, hence, a slit need not be provided. Thus, the terminal fitting is less susceptible to deformation and damage against an external force by eliminating slits.

Further, the protection walls 31 project toward each other from the respective side walls 13. Thus, the protection walls 31 are highly rigid, as compared to a protection wall continuous with only one side wall and extending to the other side wall.

Further, since the protection wall 31 can be formed by being bent along the straight bending edge L1 from the front end 12A of the bottom wall 12, the protection wall 31 can be formed easily.

A second embodiment is described with reference to FIGS. 8 to 10. A terminal fitting 101 of the second embodiment is obtained by changing the configuration of the protection walls 31 of the first embodiment and components corresponding to those of the first embodiment are denoted by the reference signs of the first embodiment plus 100. The same components, functions and effects as those of the first embodiment are not described, and the same components as those of the first embodiment are denoted by the same reference signs.

Figure 8:
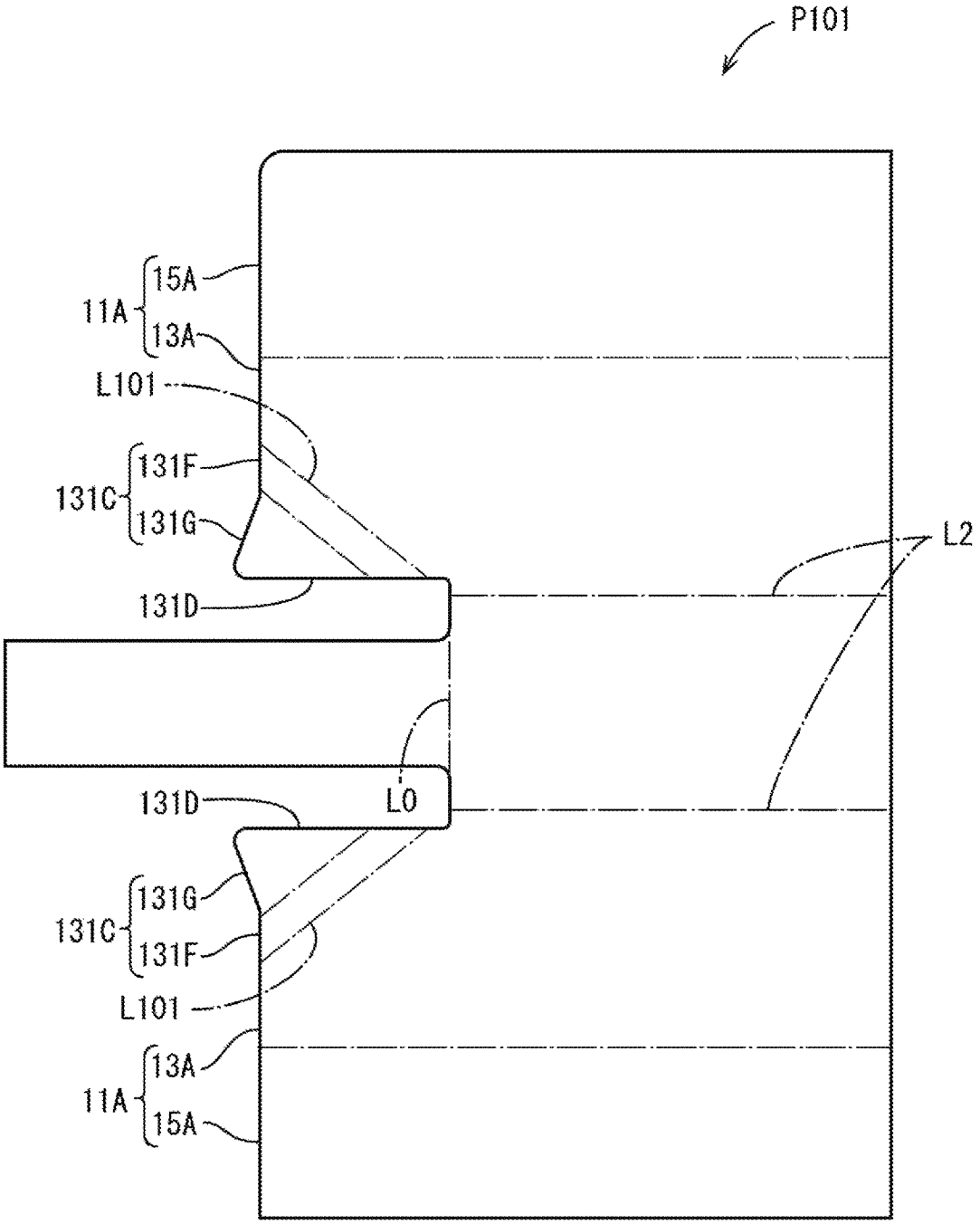
FIG. 8 is a view showing a development state of a terminal fitting of a second embodiment in a simplified manner.

The entire upper edge 31C of the protection wall 31 is shaped into a straight shape together with the front end edge 13A of the side wall 13 in the state of the metal plate material P1 shown in FIG. 2 in the terminal fitting 1 of the first embodiment, whereas an upper edge 131F of a curved portion 131A and an upper edge 131G of a flat plate 131B constituting an upper edge 131 of a protection wall 131 are connected at an angle larger than 180° in a state of a metal plate material P101 shown in FIG. 8 in the terminal fitting 101 of this embodiment. The upper edge 131F of the curved portion 131A is formed into a straight shape together with a front edge 13A of a side wall 13 and the upper edge 131G and a lower edge 131G of the flat plate 131B are at an acute angle. Specifically, the flat plate 131B of this embodiment includes a part projecting farther forward than an extension line of the front end edge 13A of the side wall 13 and accordingly has a larger area than the flat plate 31B of the first embodiment.

Figure 9:
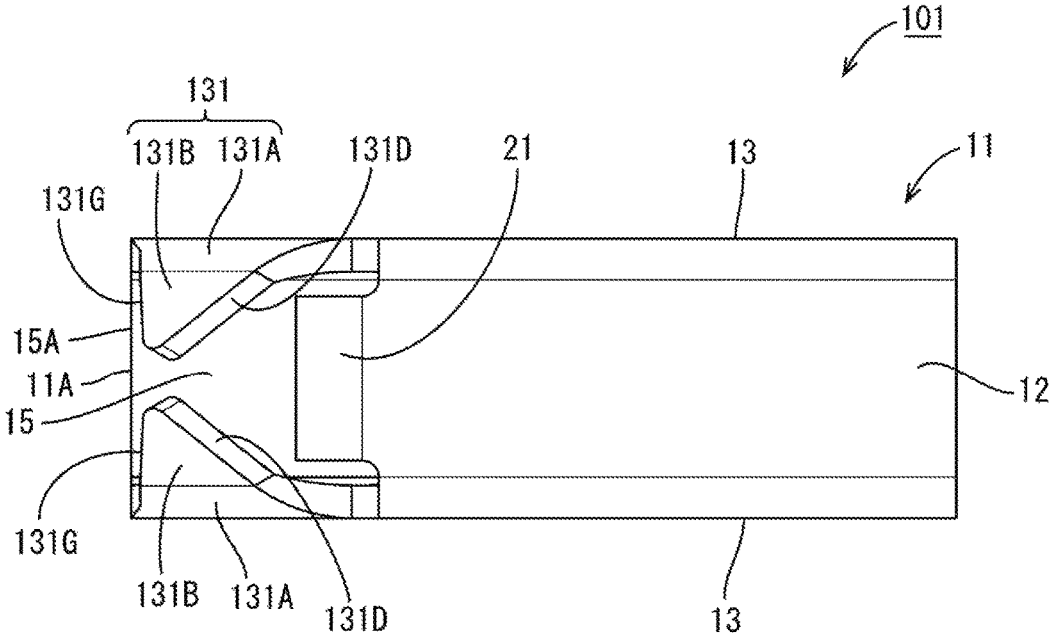
FIG. 9 is a bottom view of the terminal fitting.
Figure 10:
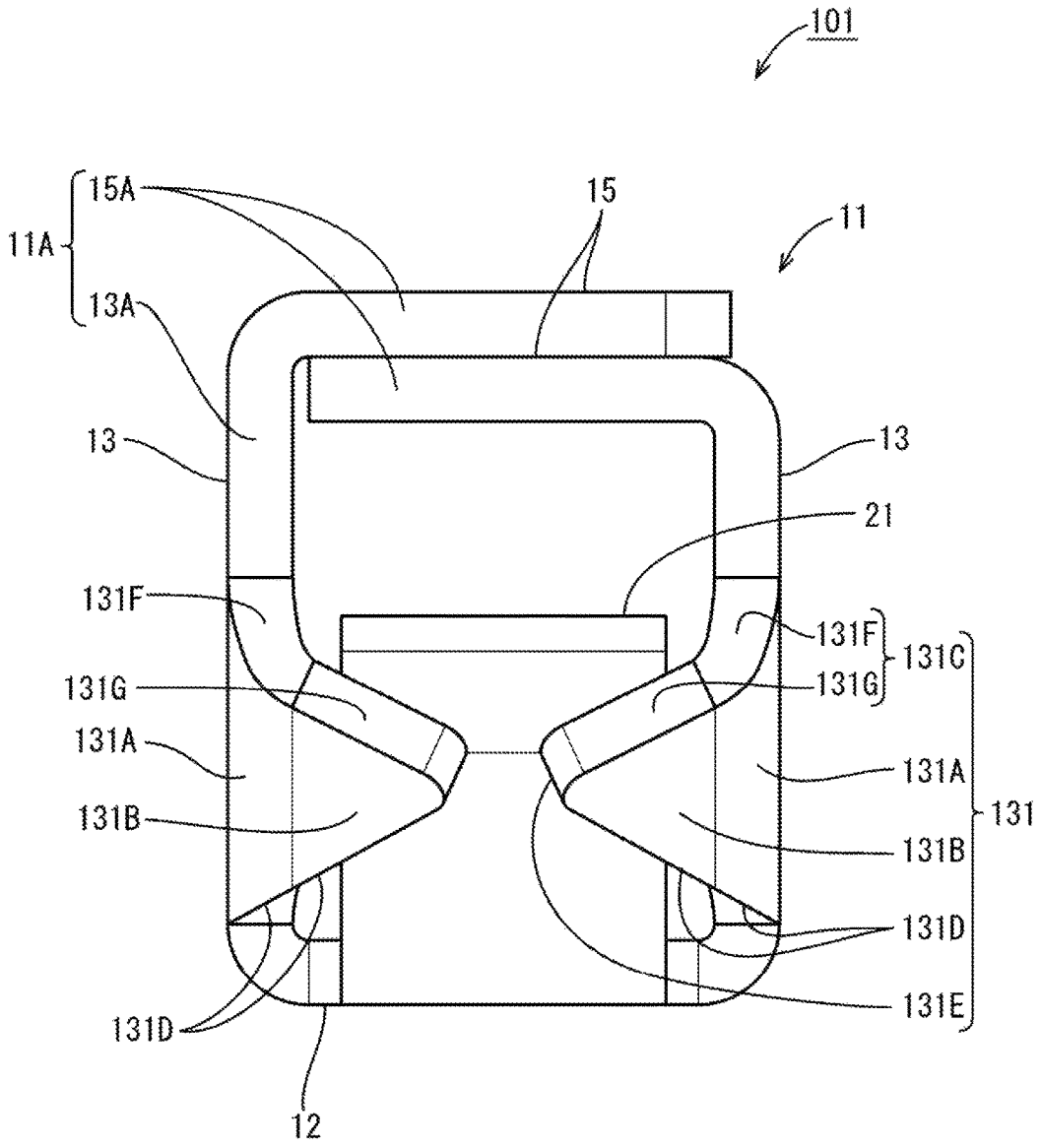
FIG. 10 is a front view of the terminal fitting.

In this way, as shown in FIG. 9, the upper edge 131G of the flat plate 131B of the protection wall 131 and a front edge 15A of a ceiling wall 15 are disposed substantially in parallel in a bottom view in a state where the metal plate material P101 is bent from a bending edge L101. Further, in this state, both corner parts 31E of the protection walls 31 of the first embodiment are spaced apart by about twice the plate thickness, as shown in FIG. 3, whereas both corners 131E, 131E of the protection walls 131 of this embodiment are spaced apart by about the plate thickness, as shown in FIG. 10. Further, the corners 131E are somewhat closer to the upper surface of the resilient contact piece 21 than the corner parts 31E of the first embodiment in a front view.

The invention is not limited to the above described and illustrated embodiments and can be, for example, embodied as follows.

Although the protection walls 31 extend from both of the side walls 13 in the above embodiments, a protection wall may extend only from one side wall.

The resilient contact piece 21 is a cantilevered rearward from the front end 12A of the bottom wall 12 and extends along the bottom wall 12 in the above embodiments. However, the shape and arrangement of the resilient contact piece 21 are not limited. For example, a resilient contact piece may extend rearward from a position receded from a front end of a bottom wall or forward from a rear end of a rectangular tube. Further, a resilient contact piece may be formed separately from a bottom wall. In short, a resilient contact piece and protection walls only have to overlap in a front view.

Although the bending edge L1 is straight in the above embodiments, a bending edge is not so limited and may be curved toward the ceiling wall or curved toward the bottom wall. Further, a flat plate need not be provided on a tip of a curved portion in a protection wall. A curved portion may be provided on a tip of a flat plate, or a protection wall may be entirely curved or entirely flat.

The shapes of the protection walls 31, 131 shown above are exemplary. For example, protection walls can have an arbitrary shape and corner parts thereof can be arranged at desired positions by changing lengths of upper and lower edges, angles between the upper and lower edges and the like of side walls. In this way, an area of the resilient contact piece 121 covered by the protection walls 131 can be increased and the clearance for allowing the entrance of the tab T can be narrowed if necessary to protect the resilient contact piece 121 more reliably.

LIST OF REFERENCE SIGNS

11: rectangular tube
13: side wall
13A: front end edge
12: bottom wall
15: ceiling wall
31, 131: protection wall
21: resilient contact piece
L1: bending edge

What is claimed is:

1. A terminal fitting to be connected to a mating terminal fitting with a tab, comprising:

a rectangular tube extending in forward and backward directions, the rectangular tube having a bottom wall with a front end, first and second side walls projecting substantially perpendicularly from the bottom wall and portions of the first and second side walls extending forward of the front end of the bottom wall, and a ceiling wall continuous from at least one of the side walls and facing the bottom wall, a resilient contact piece arranged along the bottom wall inside the rectangular tube; and at least one protection wall continuous with at least one of the side walls a bending edge provided between the at least one protection wall and the at least one of the side walls, the bending edge extending from the front end of the bottom wall towards a front edge of the side wall and arranged to approach the ceiling wall, the at least one protection wall bent at the bending edge toward the other side wall so that the at least one protection wall is disposed forward of the front end of the bottom wall, and a clearance for allowing the entrance of the tab provided between the protection wall and the ceiling wall.

2. The terminal fitting of claim 1, wherein the at least one protection wall comprises first and second protection walls provided respectively on the first and second side walls.

3. The terminal fitting of claim 2, wherein the bending edge is straight and connects the front end of the bottom wall and the front end edge of the side wall.

4. The terminal fitting of claim 1, wherein the bending edge extends obliquely to the bottom wall.

* * * * *